US009534391B2

(12) United States Patent
Haley et al.

(10) Patent No.: US 9,534,391 B2
(45) Date of Patent: Jan. 3, 2017

(54) GUTTER, GUTTER ASSEMBLIES AND COMPONENTS THEREFOR

(71) Applicant: ECO GUTTER IP HOLDINGS PTY LTD, Southport, Queensland (AU)

(72) Inventors: Alan Bryan Creighton Haley, Maudsland (AU); John Edward Dobbe, Upper Moutere (NZ)

(73) Assignee: ECO GUTTER IP HOLDINGS PTY LTD, Southport (AU)

( * ) Notice: Subject to any disclaimer, the term of this patent is extended or adjusted under 35 U.S.C. 154(b) by 0 days.

(21) Appl. No.: 14/438,586

(22) PCT Filed: Oct. 26, 2013

(86) PCT No.: PCT/IB2013/059682
§ 371 (c)(1),
(2) Date: Apr. 24, 2015

(87) PCT Pub. No.: WO2014/064659
PCT Pub. Date: May 1, 2014

(65) Prior Publication Data

US 2015/0292210 A1 Oct. 15, 2015

(30) Foreign Application Priority Data

Oct. 26, 2012 (NZ) ..... 603250

(51) Int. Cl.
*E04D 13/00* (2006.01)
*E04D 13/076* (2006.01)
(Continued)

(52) U.S. Cl.
CPC ..... *E04D 13/076* (2013.01); *E04D 13/068* (2013.01); *E04D 13/0641* (2013.01);
(Continued)

(58) Field of Classification Search
CPC ..... E04D 13/076; E04D 13/0725; E04D 13/0643; E04D 13/068; E04D 13/08; E04D 13/0645; E04D 13/0641; E04D 13/0722
(Continued)

(56) References Cited

U.S. PATENT DOCUMENTS 2,271,081 A * 1/1942 Layton ..... E04D 13/076 210/474
2,672,832 A * 3/1954 Goetz ..... E04D 13/0725 248/48.1
(Continued)

FOREIGN PATENT DOCUMENTS

AU 2009222594 A1 4/2010
AU 333250 10/2010
(Continued)

*Primary Examiner* — Basil Katcheves
(74) *Attorney, Agent, or Firm* — Seed Intellectual Property Law Group LLP

(57) ABSTRACT

A covered gutter system comprising a covered gutter, mounting bracket and fittings a providing an elongate channel in which to receive water from an overhead water feed (such as a roof), wherein the water may from time to time be carrying solid content, said covered gutter comprising: a) a channel formation comprising front and rear walls upstanding from a base region to define a channel, and b) a cover formation extending from the rear wall of the channel formation and over the channel, there being an undercut portion of the cover which, together with an upper edge of the front wall of the channel, defines an elongate mouth opening along the gutter, and wherein said cover formation is adapted to guide water from the water feed through the mouth opening and into the channel, while assisting to deflect solid content away from the mouth opening. A bracket where the inside profile of the bracket corresponds with the outside profile of the covered gutter.

10 Claims, 9 Drawing Sheets

(51) Int. Cl.
*E04D 13/064* (2006.01)
*E04D 13/072* (2006.01)
*E04D 13/068* (2006.01)
*E04D 13/08* (2006.01)

(52) U.S. Cl.
CPC ..... *E04D 13/0643* (2013.01); *E04D 13/0645* (2013.01); *E04D 13/0722* (2013.01); *E04D 13/08* (2013.01)

(58) Field of Classification Search
USPC ..... 52/12, 11
See application file for complete search history.

(56) References Cited

U.S. PATENT DOCUMENTS 4,257,716 A * 3/1981 Woodrow ..... E04D 13/0641 405/118
4,497,146 A * 2/1985 Demartini ..... E04D 13/076 52/11
5,373,879 A 12/1994 Kühnhenrich
5,491,998 A 2/1996 Hansen
5,737,879 A * 4/1998 Sweet ..... E04D 13/076 248/48.1
5,845,435 A * 12/1998 Knudson ..... E04D 13/076 248/48.1
5,878,533 A 3/1999 Swanfeld, Jr.
5,911,659 A * 6/1999 Serano ..... E04D 13/076 52/11
5,960,591 A * 10/1999 Schluter ..... E04D 13/0459 248/48.1
6,269,592 B1 8/2001 Rutter
6,701,674 B1 * 3/2004 Albracht ..... E04D 13/0725 52/11
6,823,630 B2 11/2004 Marra
7,117,643 B2 10/2006 Brown
7,624,541 B2 * 12/2009 Gentry ..... E04D 13/076 248/48.1
8,297,000 B1 * 10/2012 Demartini ..... E04D 13/076 52/12
2002/0124476 A1 * 9/2002 Iannelli ..... E04D 13/076 52/11
2004/0000098 A1 * 1/2004 Knudson ..... E04D 13/076 52/12
2004/0083657 A1 5/2004 Bullinger
2004/0115159 A1 6/2004 Tadlock et al.
2004/0244302 A1 * 12/2004 Neumann ..... E04D 13/076 52/11
2004/0244304 A1 12/2004 Bullinger
2007/0119104 A1 5/2007 Pijanowski
2007/0220814 A1 * 9/2007 Faulks ..... E04D 13/064 52/12
2009/0019786 A1 1/2009 Bachman
2009/0139180 A1 6/2009 Kehs et al.
2009/0235592 A1 * 9/2009 Knudson ..... E04D 13/076 52/12
2011/0126477 A1 * 6/2011 Hurn ..... E04D 13/076 52/12
2011/0138697 A1 * 6/2011 Martin ..... E04D 13/0725 52/12
2012/0222366 A1 * 9/2012 Steinberg ..... E04D 13/076 52/12

FOREIGN PATENT DOCUMENTS

GB 2 002 046 A 2/1979
JP 2002-167914 A 6/2002
NZ 534685 A 1/2006
NZ 550828 A 11/2007
NZ 413783 8/2010
NZ 551045 A 12/2011
WO 96/34163 A1 10/1996
WO 01/33010 A1 5/2001
WO 2005/098161 A1 10/2005
WO 2011/148362 A1 12/2011

* cited by examiner

GUTTER, GUTTER ASSEMBLIES AND COMPONENTS THEREFOR

FIELD OF THE INVENTION

The invention relates to gutters and guttering systems, and in particular to covered gutters and guttering systems mounted for channeling water from building surfaces, and also to methods of manufacture and installation of the component parts of such guttering systems.

BACKGROUND

Gutters for channeling rain water can often become clogged and obstructed by debris carried with the flow of rain water as it washes from building surfaces. Once clogged, the ability of the gutter to efficiently channel the flow will be compromised, or it may simply fill up with water and overflow.

Because guttering is typically mounted near the roof and/or upper regions of the building it can be difficult and unsafe to access the channel in order to clean it. The geometry of the channel can make it difficult, messy and time consuming to clean.

Placing a mesh or cover over the open top of the channel is not always effective in keeping out debris, and can make cleaning even more difficult in the event that clogging does occur. Covering the gutter may also encourage vermin and birds to nest inside the channel, thus causing further obstruction to the water flow.

Providing covering for the gutter channel and other guttering components increases the complexity of installing gutter systems and increases the number of components required. In particular additional support bracketing is often required to secure the covering components relative to the channel because the covers are susceptible to damage in heavy weather condition conditions (e.g. snow, high winds etc).

Some buildings have ample available space on the fascia and/or beneath the eaves of the roof for mounting guttering, and some have little available space. Some buildings have insufficient space to mount both a gutter channel and to cover extend over the channel. The present invention therefore recognises an advantage in providing a gutter that can be conveniently installed on a variety of buildings, even some of those which have lesser space available for mounting the gutter arrangement.

It is therefore an object of the present invention to provide a gutter channel which overcomes or at least in part ameliorates some of the abovementioned disadvantages or which at least provides the public with a useful choice.

It is an additional or alternative object of the present invention to provide a guttering system which overcomes or at least in part ameliorates some of the abovementioned disadvantages or which at least provides the public with a useful choice.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

BRIEF DESCRIPTION OF THE INVENTION

In a first aspect the invention may broadly be said to be a covered gutter to receive rain water from a building surface (such as a roof) yet allow solid material that may be carried by the water to pass by the gutter, said gutter comprising:

1) a channel formation comprising of
   a) a base
   b) a first flange upstanding from said base
   c) a second flange upstanding from said base and having a distal edge;
   together defining a channel to carry rain water and
2) a cover extending over the channel in a manner to define a mouth opening with the distal edge of the second flange, the cover being adapted and configured to allow water received thereon from above to flow or be guided to said mouth opening and into the channel yet allow solid material to pass by the gutter and not into the channel formation.

Preferably said cover extends between and preferably from the first flange in a manner to define a mouth opening with the distal edge of the second flange.

Preferably the cover slopes downwardly toward the distal edge of the second flange.

Preferably said covered gutter has a longitudinally extending channel axis which is located at the centre point of the channel.

Preferably the cover of the covered gutter has an upwardly projecting profile feature for engagement with a bracket or retaining device.

Preferably the bracket or retaining device is a gutter support bracket that can support the gutter relative to a building structure.

Preferably said projecting profile feature extends longitudinally along the cover in a plane parallel to the channel axis.

Preferably said projecting profile feature extends longitudinally along the cover in a plane parallel to the channel axis and is set away from the first flange.

Preferably the cover and/or the first flange are supported so as to retain the spacing of the mouth opening between them.

Preferably a prop is provided to keep the mouth opening constant.

Preferably a prop is provided to locate with the cover and the second flange to keep the size of the mount opening constant.

Preferably a plurality of props are provided each spaced from each other and along the channel axis.

Preferably the prop is provided by a feature or features of the support bracket.

Preferably the supporting function is performed at least in part by the bracket or retaining device.

Preferably the bracket can be fastened to a building structure and extend from the building structure in a manner for the base to be upwardly supported by said bracket.

Preferably the bracket is able to be presented to extend contiguous the second flange.

Preferably the bracket is able to be presented to bridge the mouth opening and engage with the second flange and cover in a manner to keep their relative disposition at the mouth opening.

Preferably the channel formation and cover are formed as an integral profile from a single sheet of material.

Preferably the channel formation and cover are formed as an integral profile from a single sheet of material by way of a roll forming operation about the channel axis or an axis which is offset from but parallel to the channel axis.

Preferably the first flange extends from the base to an upper end that is distal from the base.

Preferably the first flange is substantially planar.

Preferably the upper end of the first flange is located, in use, above the distal edge of the second flange.

Preferably the upper end of the first flange is located, in use, above distal edge of the second flange so that any water overflow from the channel is via the mouth opening.

Preferably the mouth opening, in use, is positioned distal from the building from which the gutter is supported.

Preferably the mouth opening is defined between an undercut portion of the cover and the distal edge of the second flange.

Preferably the undercut region is an arcuate region of the cover.

Preferably said sheet material is a metal.

Preferably said sheet material is aluminium or steel.

Preferably any overflow of water from the channel can only exit the gutter through the mouth opening.

Preferably the mouth opening is between 0-20 mm in width.

Preferably the mouth opening is between 8-12 mm in width.

In another aspect the invention may broadly be said to be a covered gutter providing an elongate channel in which to receive water from an overhead water feed (such as a roof) the water may from time to time be carrying solid content, said gutter comprising:

1) a channel formation comprising front and rear walls upstanding from a base, each wall having an upper elongate end distal from the base and together defining a channel, and
2) a cover formation with elongate front and rear ends, its rear end connected to and extending from the upper end of the rear wall of the channel formation, and its front end including a curved profile wherein the front end of the cover formation and the upper end of the front wall of the channel formation define a longitudinal opening extending along the covered gutter, and wherein said cover formation is adapted to guide water from the water feed through the longitudinal opening and into the channel, while deflecting any solid content away from the longitudinal opening.

Preferably the front and rear ends of the cover are elongate and parallel to each other.

Preferably the front and rear ends of the cover and upper ends of the front and rear walls are elongate and parallel to each other.

Preferably the cover slopes from its rear end downwardly toward its front end.

Preferably the curved profile extends from the rear wall to and beyond a vertical plane that is coincident the upper end of the front wall.

Preferably the curved profile extends from the rear wall to and beyond a vertical plane that is coincident the narrowest portion of the longitudinal opening.

Preferably the curved profile of the front end terminates in a free edge, said free edge being located inside of a plane extending vertically upward from the upper end of the front sidewall.

Preferably the curved profile defines an undercut thereof above the longitudinal opening.

Preferably spaced apart at intervals along the longitudinal opening are props that keep the opening open.

Preferably the props extend across the opening and each engage with both the front wall and the cover.

Preferably the props are spaced apart so that the opening remains substantially un-occluded by the props.

Preferably the props form part of a bracket used to secure the gutter to a building structure.

Preferably the bracket is of a kind as herein described.

Preferably the gutter as herein above described is of a constant cross section. Preferably the gutter as herein above described is straight and is of a constant cross section along its length.

Preferably any overflow of water from the channel can only exit the gutter through the mouth opening.

Preferably the longitudinal opening is between 0-20 mm in width.

Preferably the longitudinal opening is between 8-12 mm in width.

Preferably the channel formation and cover formation are formed as an integral profile from a single sheet of material.

Preferably the channel formation and cover formation are formed as an integral profile from a single sheet of material by way of a roll forming operation about the elongate axis or an axis which is offset from but parallel to the elongate axis.

In another aspect the invention may broadly be said to be a bracket to support a covered gutter providing an elongate channel in which to receive water from an overhead water feed (such as a roof) the water may from time to time be carrying solid content, said gutter comprising:

1) a channel formation comprising front and rear walls upstanding from a base, each wall having an upper elongate ends distal from the base and together defining a channel, and
2) a cover formation with elongate front and rear ends, its rear end connected to and extending from the upper end of the rear wall of the channel formation, and its front end including a curved profile wherein the front end of the cover formation and the upper end of the front wall of the channel formation define a longitudinal opening extending along the covered gutter, and wherein said cover formation is adapted to guide water from the water feed through the longitudinal opening and into the channel, while deflecting any solid content away from the longitudinal opening, the bracket comprising:

a receptacle region to receive the gutter and become contiguous the rearwall, base and front wall of the channel formation.

Preferably the bracket in use is contiguous the entire base of the channel formation.

Preferably the bracket in use is contiguous the entire rear wall of the channel formation.

Preferably the bracket in use is contiguous the entire front wall of the channel formation.

Preferably the bracket in use is contiguous the entire base of the channel formation.

Preferably the bracket in use is contiguous the entire base of the channel formation.

Preferably the bracket engages an upstand or projection of the cover located at or near the upper end of the rearwall.

Preferably the bracket includes a downwardly projecting lip at where it can engage the upstand.

Preferably the bracket includes a downwardly projecting lip at its upper end for location with a fastening region of the gutter (preferably the upstand).

Preferably the bracket provides an elastically deformable clip for engaging the gutter.

Preferably the bracket is made from a sheet material.

Preferably the bracket is made from a strip of sheet material.

Preferably the bracket includes a prop region that extends across the opening and engaged with the front wall and cover to ensure the opening remains open.

Preferably the bracket includes a prop region that is adapted and configured to keep the opening open.

Preferably the bracket is articulated so that it can be moved from a gutter receiving condition and a supporting condition where the region of the bracket to be contiguous the front wall is in use higher than when in the receiving condition.

Preferably the bracket is articulated at the region thereof to be contiguous the base.

Preferably the bracket is fastened to the gutter when in its supporting condition.

Preferably the bracket is fastened to the gutter at the curved region of the cover formation.

Preferably the bracket is fastened to the gutter at the front wall of the channel formation.

In another aspect the invention may be broadly be said to be a bracket with an inner profile that complements or corresponds to at least part of the outer profile of a covered gutter as previously described.

Preferably said bracket contacts the covered gutter over a substantial majority of points around its outer profile.

Preferably said bracket contacts the covered gutter over a substantial majority of points around the outer profile of the channel formation only.

Preferably the bracket has upper and lower regions separated at a hinge point about which said regions are able to articulate relative to each other so that the bracket can assume an open condition and a closed condition.

Preferably said hinge point is located in that region of the bracket which is in contact with the base of the gutter.

In another aspect the invention may broadly be said to be a section terminator which is adapted to terminate an open ended section of a covered gutter as previously described.

Preferably the section terminator shares substantially the same cross sectional profile as the section which it is adapted to terminate.

Preferably the section terminator has a longitudinally extending aperture through which water can enter the interior of the section terminator.

Preferably the regions of the longitudinally extending aperture are bridged by a reinforcing panel which extends across the aperture to increases the stiffness and/or load integrity of the section terminator.

Preferably the section terminator includes a perimeter lip of lips to lap the distal end of the gutter.

Preferably the lip or lips lap the channel formation and the cover.

Preferably the lip or lips overlap the gutter.

Preferably the section terminator is an end cap adapted to connect to and cover over an open end of the gutter.

Preferably the section terminator is adapted to connect the open ends of two sections of a covered gutter.

Preferably the section terminator is adapted to connect the open ends of two sections of the covered gutter as previously described.

Preferably each gutter section has a longitudinal channeling axis, and preferably the section terminator is adapted to connect the open ends of two gutter sections wherein said sections are in co-axial alignment.

Preferably said section terminator is adapted to further receive the open upper end of a down pipe.

Preferably said section terminator comprises a connector body with lower and upper parts in sliding or snap-fit association with one another.

Preferably each gutter section has a longitudinal channeling axis, and preferably the section terminator is adapted to connect the open ends of two gutter sections oriented with an angular offset between their respective longitudinal channeling axes.

Preferably the angular offset between the respective longitudinal channeling axes is 135 degrees.

Preferably the angular offset between the respective longitudinal channeling axes is 90 degrees.

Preferably the section terminator comprises a rigid corner-shaped body with end regions opening in angularly offset planes relative to one another.

Preferably the longitudinal aperture runs along the inside of the corner defined by the corner-shaped body.

Preferably the longitudinal aperture runs along the outside of the corner defined by the corner-shaped body.

Preferably said section terminator has an aperture or port.

Preferably said aperture or port is closeable or able to be sealed with a cap.

Preferably the port is an inspection port.

Preferably the port is presented for inspection by a person from above.

Preferably a or the port is provided by the section terminator on a lateral side of the section terminator and located to allow a water assisted flushing of any solid matter collected in the channel from the channel.

Preferably the section terminator comprises one or more moulded plastic parts.

Preferably the section terminator comprises a lid portion and a body portion which are associate in such a way as to accommodate contraction and expansion of a metal gutter section received within an open end of the section terminator.

In another aspect the invention may broadly be said to be an assembly comprising a covered gutter as previously described retained within or supported by a bracket as previously described.

In another aspect the invention may broadly be said to be an assembly comprising a section terminator as previously described and one or more open ended sections of a covered gutter as previously described.

In another aspect the invention may broadly be said to be a kit of parts for a guttering system comprising one or more of each of:

a) a covered gutter as previously described, b) a bracket as previously described and c) a section terminator as previously described.

In another aspect the invention may broadly be said to be a method of installing a covered gutter section as previously described comprising the steps of:

1) mounting a series of brackets as previously described in a horizontally level alignment by optionally installing packing to assist in the alignment of the bracket and affixing the upper region of the bracket to a building surface 2) optionally, if said brackets are presented in the closed condition, articulating the lower region of the bracket about the hinge point to its open condition, 3) disposing the gutter section horizontally and placing it to be received simultaneously by all of the brackets, so that the projecting profile feature of the gutter engages with each of the brackets, and 4) articulating each bracket to its closed condition such that the gutter section is retained therein.

In another aspect the invention can be said to broadly consist in a covered gutter assembly comprising a covered gutter and at least one bracket, said bracket adapted to be fixed to a building and to support the covered gutter once so fixed, said covered gutter providing an elongate channel in which to receive water from an overhead water feed (such as a roof), wherein the water may from time to time be carrying solid content, said covered gutter comprising:

a) a channel formation comprising front and rear walls upstanding from a base region to define a channel, and b) a cover formation extending from the rear wall of the channel formation and over the channel, there being an undercut portion of the cover which, together with an upper edge of the front wall of the channel, defines an elongate mouth opening along the gutter, and wherein said cover formation is adapted to guide water from the water feed through the mouth opening and into the channel, while assisting to deflect solid content away from the mouth opening.

In another aspect the invention can be said to broadly consist in a covered gutter assembly comprising an open ended section of covered guttering and a section terminator configured and adapted to engage with an end region of the section of covered guttering, said covered gutter and section terminator providing a channel in which to receive water from an overhead water feed (such as a roof), wherein the water may from time to time be carrying solid content, each of said covered gutter and said section terminator comprising:

a) a channel formation comprising front and rear walls upstanding from a base region to define a channel, and b) a cover formation extending from the rear wall of the channel formation and over the channel, there being an undercut portion of the cover which, together with an upper edge of the front wall of the channel, defines an elongate mouth opening substantially aligned with the channel axis, and wherein said cover formation is adapted to guide water from the water feed through the mouth opening and into the channel, while assisting to deflect solid content away from the mouth opening.

In another aspect the invention can be said to broadly consist in a covered gutter providing a channel in which to receive water from an overhead water feed (such as a roof), wherein the water may from time to time be carrying solid content, said covered gutter comprising:

a) a channel formation comprising front and rear walls upstanding from a base region to define a channel, and b) a cover formation extending from the rear wall of the channel formation and over the channel, there being an undercut portion of the cover which, together with an upper edge of the front wall of the channel, defines an elongate mouth opening along the gutter, and wherein said cover formation is adapted to guide water from the water feed through the mouth opening and into the channel, while assisting to deflect solid content away from the mouth opening.

In respect of the preceding three aspects of the invention, the following preferments apply:

Preferably any overflow of water from the channel can only exit the gutter through the mouth opening.

Preferably said cover extends from an upper edge of the rear wall of the channel formation.

Preferably the upper edge of the rear wall is above the upper edge of the front wall, and a region of the cover slopes downwardly toward the front wall.

Preferably the profile of the undercut region of the cover formation extends beyond a vertical plane that is coincident the upper end of the front wall of the channel formation.

Preferably the covered gutter is of a constant cross section along its length.

Preferably the channel formation and cover are formed as an integral profile from a single sheet of material.

Preferably the channel formation and cover are formed as an integral profile from a single sheet of material by way of a roll forming operation about the channel axis or an axis which is offset from but parallel to the channel axis.

Preferably said sheet material is a metal.

Preferably said gutter is adapted and configured such that, when mounted on a sidewall of a building, the mouth opening is positioned distal from the wall of the building on which the gutter is mounted.

Preferably the undercut portion of the cover terminates at a free edge, said edge defining a drip flange inwardly of the front wall of the channel, said drip flange configured to cause water which has been guided through the mouth opening to drop into the channel.

Preferably the undercut region is an arcuate region of the cover.

Preferably there is a drip flange that extends inwardly of the upper edge of the front wall of the channel and slopes downwardly into the channel.

Preferably the mouth opening is between 0-20 mm in width.

Preferably the mouth opening is between 8-12 mm in width.

Preferably the cover of the covered gutter has a projecting profile feature for engagement with a retaining device.

Preferably said projecting profile feature extends longitudinally along the cover in a direction parallel to the elongate axis of the covered gutter.

Preferably further comprising a prop to bridge across the mouth opening in order to retain the mouth opening at a constant width.

Preferably further comprising a prop which locates with the cover and the second flange to retain the mouth opening at a constant width.

Preferably a plurality of props are provided at spaced distances along the channel.

Preferably the props are spaced apart so that the mouth opening remains substantially un-occluded by the props.

Preferably an inner profile of the bracket complements or corresponds to at least part of the outer profile of the covered gutter.

Preferably wherein the bracket is adapted and configured to enable fastening to a building, so that, when fastened, the bracket may support the gutter from beneath the base of the channel formation.

Preferably the bracket is contiguous to the base of the channel and to one or more regions of both or either of:

a) the front wall of the channel formation and b) the rear wall of the channel formation.

Preferably the bracket is contiguous about the entire exterior profile of the channel formation.

Preferably said bracket contacts the covered gutter around a substantial majority of the outer profile of the gutter.

Preferably a feature or features of the support bracket provide a prop to engage with one or both of the cover and the channel formation in order to retain the mouth opening at a constant width.

Preferably said prop engages with the undercut region of the channel formation.

Preferably the bracket engages an upstand or projection of the cover.

Preferably the bracket includes a downwardly projecting lip which engages the upstand or projection of the cover.

Preferably the bracket provides an elastically deformable clip for engaging the gutter.

Preferably said bracket is made from or comprises a metal material.

Preferably the bracket is formed from a strip of sheet material.

Preferably said bracket is made from or comprises a plastics material.

Preferably said bracket supports the gutter by engagement with or by bearing upon only external surfaces of the gutter to the extent that the rigidity of the assembly (in a cross sectional plane through the gutter) is greater than that of the gutter alone.

Preferably said bracket engages with exterior regions of both the cover and the channel formation so as to bridge the mouth opening.

Preferably, in addition to the mouth opening, there is at least one aperture of the gutter that creates a discontinuity in the cross sectional profile of the gutter at that region along the gutter where the aperture is located.

Preferably said bracket engages with exterior regions of the bracket about its cross sectional periphery so as to bridge the aperture.

Preferably the bracket has a rear flange which is adapted for fastening against a planar building surface, a latch extending from an upper edge of the rear flange adapted to engage with a projection from the top of the cover formation, and a first lower member extending from a lower edge of the rear flange adapted to engage with the base of the channel formation, such that the covered gutter, when so engaged with the bracket, is constrained from movement relative to the building surface.

Preferably said latch is a resiliently deformable clip which can be deformed to release the gutter from engagement with the bracket.

Preferably said bracket, in a closed condition, has a second lower member extending from the first lower member, said second lower member adapted to extend contiguous to the exterior profile of the base and at least a substantial portion of the front wall of the channel formation (and optionally fastened to said channel formation), such that the bracket encloses a substantial majority of the outer profile of the channel formation, said second lower member being hinged relative to the first to permit the bracket to assume an open condition wherein the gutter can be removed from the bracket.

Preferably said bracket defines a cross sectional shape that substantially corresponds with or compliments at least a region of the peripheral cross section of the covered gutter such that the bracket engages with the exterior surface of the gutter at a plurality of regions about its peripheral cross section in order to support the gutter.

Preferably said bracket comprises a first element configured and adapted for mounting to a building surface, and a second element which is configured and adapted to, in situ, extend beneath the base of the channel formation, said second element being associable with the first to define a cross sectional shape that substantially corresponds with or compliments at least a region of the peripheral cross section of the covered gutter such that the bracket engages with the exterior surface of the gutter at a plurality of regions about its peripheral cross section in order to support the gutter.

Preferably said bracket, having engaged with the exterior surface of the gutter at a plurality of regions about its peripheral cross section, assists in resisting distortion or deformation of the gutter in the cross sectional plane.

Preferably said bracket engages with the gutter to the extent that the rigidity of the assembly (in a cross sectional plane through the gutter) is greater than that of the gutter alone.

Preferably said first and second elements are releasably associable with one another.

Preferably said first and second elements are configured and adapted to associate with one another by direct or indirect engagement.

Preferably said first and second elements are configured and adapted to associate with one another by way of a clip, fastener, hook, catch, receiver, latch, coupling or other form of attachment.

Preferably said first and second elements are configured and adapted to engage with one another via a hinged joint.

Preferably one or both of said first element and said second element are made from or comprise a metal material.

Preferably one or both of said first element and said second element are made from or comprise a plastics material.

Preferably one of said first and second elements is made from or comprises a plastic material, and the other is made from or comprises a metal material.

In another aspect the invention can be said to broadly consist in a covered gutter assembly comprising a covered gutter and a bracket, said covered gutter having a channel formation comprising a base with upstanding rear and front walls to define a channel, and a cover portion extending from the rear wall and over the channel to define a mouth opening with an upper edge of the front wall, said covered gutter having an open peripheral profile when viewed in cross section, said bracket also having an open peripheral profile when viewed in cross section, wherein said gutter and bracket adapted and configured for assembly with each other so as to together define a closed peripheral profile of the assembly.

In another aspect the invention can be said to broadly consist in a bracket as described above.

In another aspect the invention can be said to broadly consist in a section terminator as described above.

In another aspect the invention can be said to broadly consist in a method of installing a covered gutter assembly as described above comprising the steps of:

a) fixing the rear flange of the bracket to the building surface,
b) optionally, if said bracket presented in its closed condition, articulating the second lower member of the bracket about the hinge point so that the bracket assumes the open condition,
c) disposing the gutter section horizontally and locating it to engage with the latch and first lower member, and
d) articulating the second lower member about the hinge point to close around the exterior profile of the channel formation such that the bracket assumes the closed condition.

In another aspect the invention can be said to broadly consist in a method of installing a covered gutter assembly as described above comprising the steps of:

a) fixing the first element of the bracket to the building surface,
b) disposing the gutter section horizontally and locating it adjacent the fixed first element, and
c) optionally registering the gutter with respect to a locating and/or retaining feature of the bracket, and, if present engaging the retaining feature, d) associating the second element with the first to at least partially enclose the gutter within the bracket to be supported thereby.

In another aspect the invention may broadly be said to be a covered gutter as herein described with or without to the accompanying drawings.

In another aspect the invention may broadly be said to be a bracket as herein described with or without to the accompanying drawings.

In another aspect the invention may broadly be said to be section terminator as herein described with or without to the accompanying drawings.

In another aspect the invention may broadly be said to be a guttering system as herein described with or without to the accompanying drawings.

In another aspect the invention may broadly be said to be an assembly of guttering system components as herein described with or without to the accompanying drawings.

In another aspect the invention may broadly be said to be a kit of parts for a guttering system as herein described with or without to the accompanying drawings.

In another aspect the invention may broadly be said to be a method of installing a guttering system as herein described with or without to the accompanying drawings.

Other aspects of the invention may become apparent from the following description which is given by way of example only and with reference to the accompanying drawings.

As used herein the term "gutter" includes any type of drain, channel, chute, conduit, duct, runnel or spout.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification [and claims] which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

The invention will now be described by way of example only and with reference to the drawings in which.

DETAILED DESCRIPTION OF THE INVENTION

Figure 1:
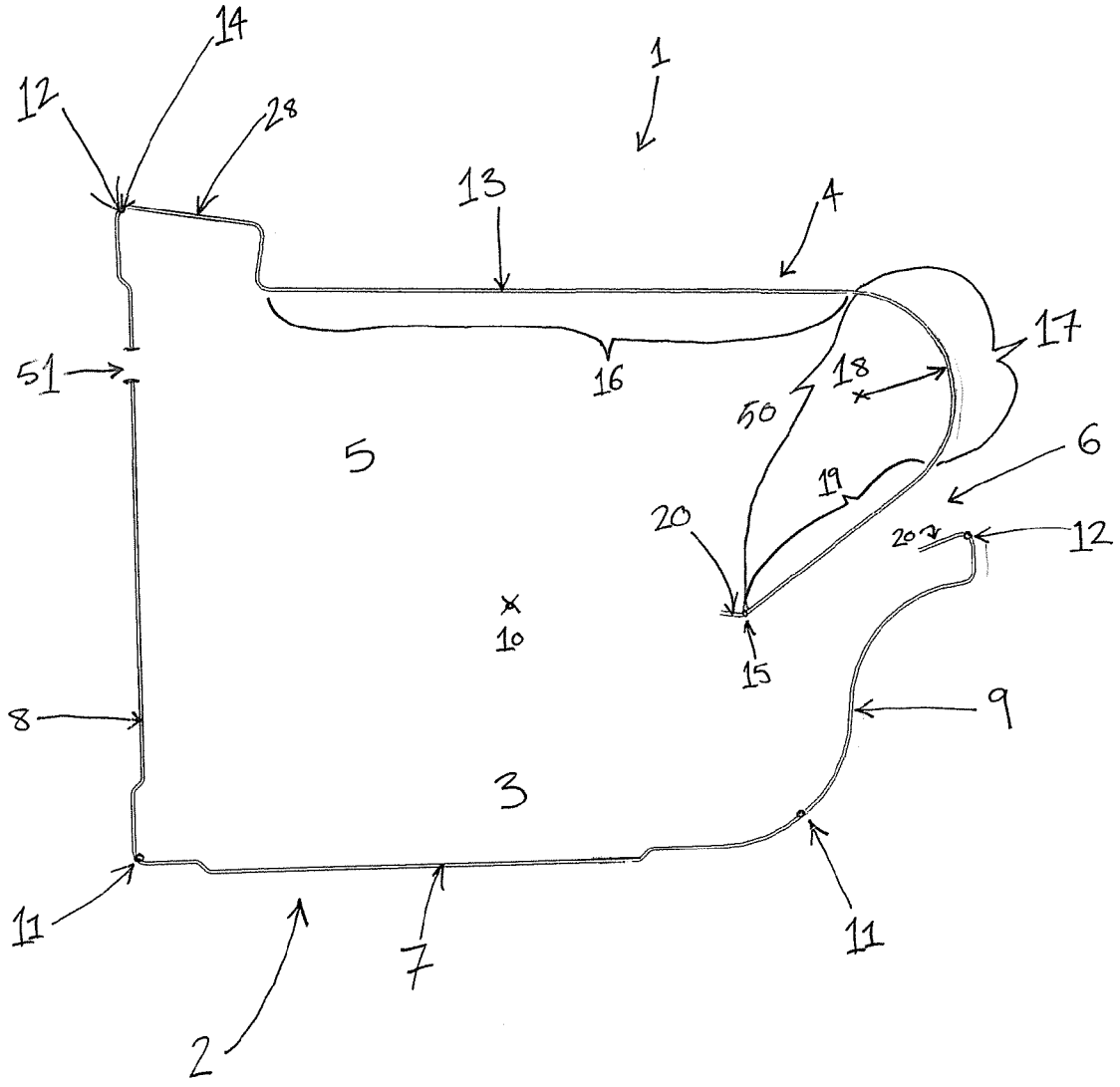
FIG. 1: shows a cross sectional view of a covered gutter of the present invention.
Figure 2:
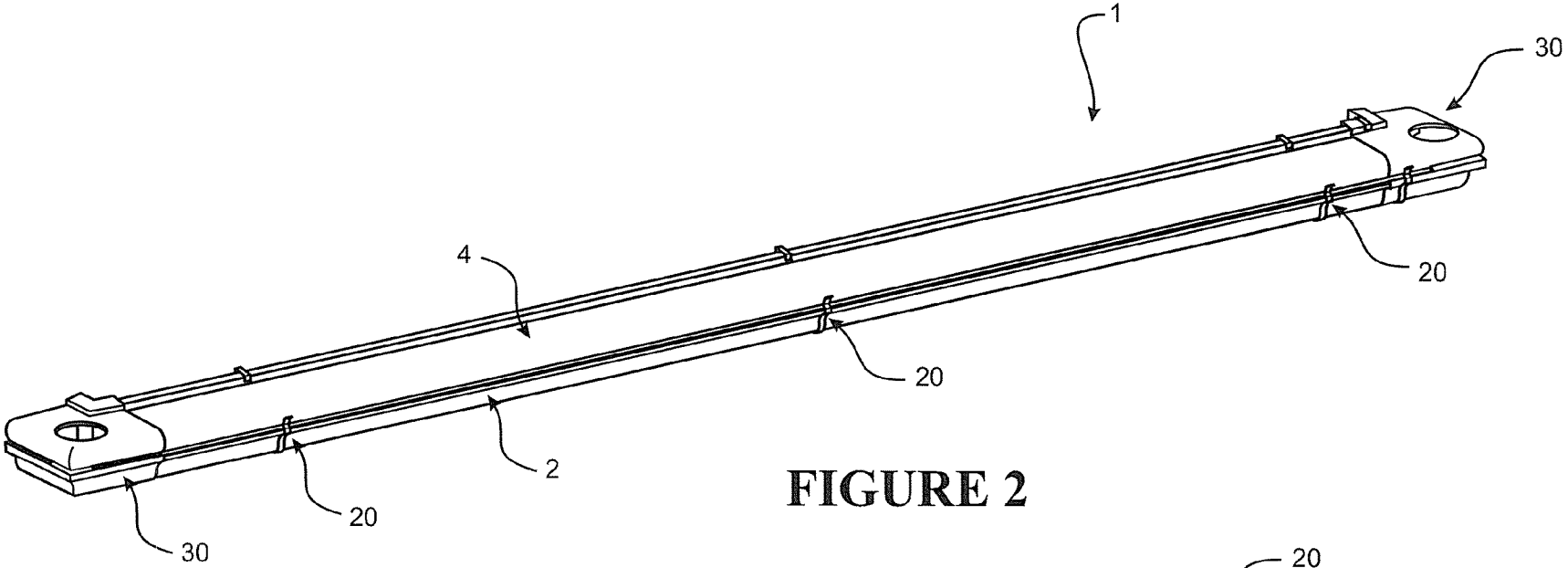
FIG. 2: shows a covered gutter mounted for use on a building surface, retained in a substantially horizontal disposition by a series of mounting brackets of the present invention.

In one embodiment now described, there is a covered gutter 1 of elongate form and having a substantially constant cross sectional profile. The gutter 1 comprises a channel formation 2 which provides an interior channel 3 into which water can be received and a cover portion 4 which depends from the channel formation 2 and covers the interior channel 3. The channel formation 2 and cover portion 4 together enclose a gutter interior space 5, which is in communication with the outside of the gutter through an elongate aperture 6. The aperture 6 provides an entry point for water to enter into the interior channel 3.

The aperture 6 is preferably narrow to prevent the entry of at least some birds and vermin. Preferably the aperture is less than 20 mm in height, and more preferably it is approximately 10 mm in height.

Preferably the channel formation 2 and cover formation 4 are integrally connected so as to form a continuous cross sectional gutter profile of an open shape, the discontinuity in the profile being the water entry aperture 6, for example as shown in FIG. 1. In a preferred embodiment the entire covered gutter 1 can be formed from a single material sheet by roll forming along its elongate axis.

Because, in preferred embodiments, the gutter interior space 5 is completely enclosed by the sidewalls 8 & 9, any emergency overflow of water will be through the aperture 6 at the front of the gutter 1, which is away from the building surface on which the gutter 1 is mounted. This prevents overflow water from running back into the eaves or soffits of the building and/or from entering the building framework.

In some embodiments there may be other apertures of the gutter (for example shown as 51 in FIG. 1), such that in at least some regions along the gutter, when viewed in cross section, there are discontinuities in the peripheral profile.

In some embodiments, the channel formation 2 comprises an elongate, substantially rectangular base flange 7 with side walls 8 & 9 adjoined to and upstanding from either of its majorly dimensioned sides. The base 7 and sidewalls 8 & 9 define the interior channel 3 with a channel axis 10 running longitudinally along the centre of the channel.

The first sidewall 8, being that which will be mounted against or most proximate to the building surface when mounted for use, is preferably higher than the second sidewall 9, that which will be farthest from the building surface when mounted for use. Preferably the first sidewall 8 extends upwardly perpendicular to the base flange 7, while the second sidewall 9 may be parallel to the first or may optionally flare outwardly from the interior channel 3. Both of the first 8 and second 9 sidewalls have a lower end 11, being that end which is joined to the base flange 7, and an upper end 12, being that end which is distal from the base flange 7.

In some embodiments the cover portion 4 comprises an elongate flange 13 which is connected at a fixed end 14 to the upper end 12 of the first sidewall 8, and extends from the sidewall 8 in the direction of the interior channel 3, terminating in a free edge 15. Preferably there is an undercut portion 50 of the cover 4 between the upper end 12 of the channel wall 8 and the free edge 15. The free edge 15 preferably terminates inside of a plane extending vertically upward from the upper end 12 of the second sidewall 9.

Wherein a low velocity water feed onto the exterior of the cover 4 (such as that which might arise as rain water runs off a roof) at or near to its fixed end 14 may tend to adhere to that exterior surface through surface tension effects, the contour of the cover portion 4 is preferably such that the flowing water would be guided into the interior channel 3 of the gutter. Consequently it is preferred that the region of the cover flange 16 near to the fixed end 14 be substantially flat and extend more or less perpendicular to the first sidewall 8, although alternatively, and more preferably, it may extend with a slight downward slope from its fixed end 14 so as to bias the flow of water toward the free edge 15.

Preferably there is also, or alternatively, a curved or arcuate region 17 of the undercut region 50 at or proximate to the free edge 15. Preferably the axis of curvature 18 of such an undercut, curved or arcuate region 50, 17 runs parallel to the fixed end 14 of the cover flange 13. Without being bound by any particular theory, the applicant believes that while water from a water feed onto the exterior of the cover 4 may tend to adhere to the surface of the undercut region 15 such that it will be guided into the interior channel 3 through the aperture 6, the momentum of leaves, debris or other solids carried in the water flow, in passing over the curved region 17, is likely to overcome any surface tension forces at this point. Consequently, leaves, debris and solids are likely to be deflected away from the aperture 6 and will not enter into the interior channel 3 so as to obstruct the flow of water therein.

Preferably there is a further region 19 of the cover flange 13 between the curved or arcuate region 17 and the free edge 15 which extends back underneath the top of the cover portion 4 into the gutter interior space 5 to ensure that the water flow is guided far enough into the interior space 5 of the gutter to be caught be the channel 3. A drip flange 20 at the free edge 15 of the cover flange 13 may optionally be present to encourage the water to drop into the channel 3 as desired. There may similarly be a drip flange 20 at the upper end 12 of the second sidewall 9.

The covered gutter 1 is to be mounted to building surfaces in use. Because the gutter channel 3 and interior space 5 ought remain largely free of debris, there is unlikely to be a need for the guttering 1 to be sloped towards downpipe or soakhole connections to ensure drainage of the channel 3. Sloped guttering is often not aesthetically pleasing because it can detract from the line of the building on which it is mounted. Therefore in a preferred embodiment the gutter 1 is to be mounted so that the base 7 of the channel formation 2 is horizontally level, or at least in an orientation which follows the line of the building on which it is mounted. Packing may be installed behind the bracket to assist in aligning the gutter 1.

Figure 3:
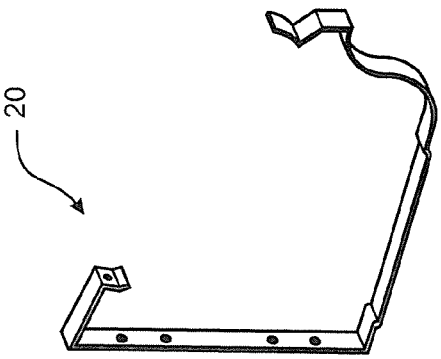
FIG. 3: shows an isometric view of a mounting bracket of the present invention.
Figure 4:
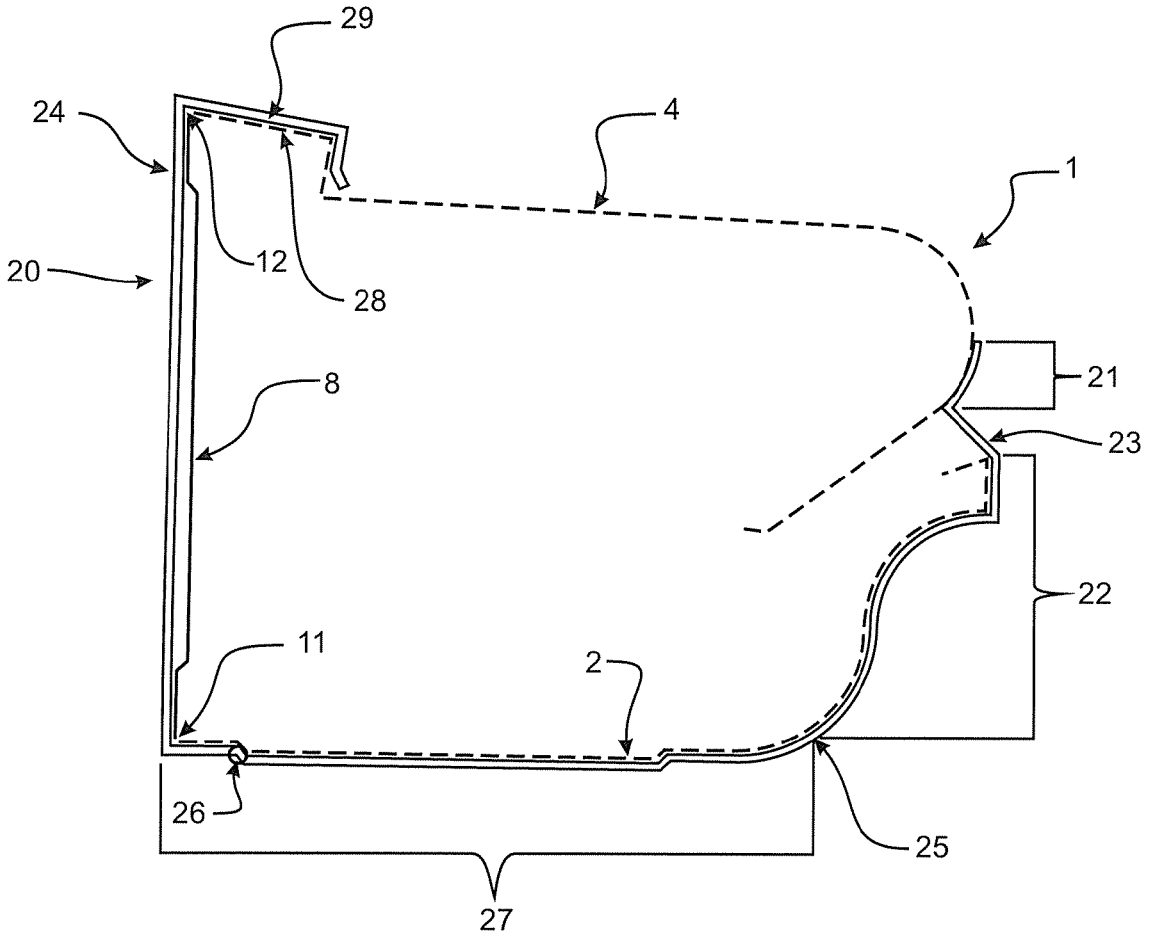
FIG. 4: shows a side on view of a mounting bracket in its closed condition, with dotted lines to show the positioning of a gutter section retained within the bracket.

The gutter 1 is preferably mounted on a series of brackets 20 (for example a bracket as shown in FIG. 3) which can be fastened or otherwise attached to a building surface prior to fitting the gutter 1. As shown in FIG. 4, preferably the brackets 20 contact only the exterior of the gutter 1, and are adapted to contact and support both the channel formation 2 and the cover portion 4 of the gutter from its exterior. Preferably the gutter 1 is fully supported without the addition of any internal support means.

In a preferred embodiment the brackets 20 are formed from a strip of plate material so that the interior surface of the bracket 20, being that surface which contacts the exterior of the gutter 1, corresponds substantially to the exterior profile of the gutter 1. In some embodiments the bracket 20 is made from or comprises either a plastics material or a metal material, however other materials may be used.

In preferred embodiments the bracket 20 at least partially encloses the gutter 1 so as to engage with regions of the exterior surfaces of the gutter 1 about its peripheral profile as shown in FIG. 4. Preferably the bracket 20 engages with a plurality of regions of the exterior surfaces of the gutter 1 about its peripheral profile. This provides support for the gutter 1 and assists in resisting deformation or distortion of the gutter 1, especially in the cross sectional plane. For example, by engaging with the cover 4 so as to support it at the arcuate region 17, the bracket may act to reinforce the cover 4 against downwards deflection or sagging that may otherwise occur over time or under loading. The bracket 20 preferably has some degree of rigidity or stiffness so as to be able to perform the reinforcing function, but may also be resilient and/or deformable to some extent. In some embodiments certain regions of the bracket 20 may be adapted to be resilient and/or deformable, for example to the extent required to allow the bracket 20 to flex as the gutter 1 is fitted into it.

In some embodiments there may be other apertures 51 of the gutter 1 (in addition to the aperture 6), such that in at least some regions along the gutter 1, when viewed in cross section, there are discontinuities in the peripheral profile. Preferably the bracket 20 is shaped and configured to bridge the mouth opening 6 or any other gaps (if present) in the profile shape. The bridging regions of the bracket 20 may assist by providing resistance against tensile and/or compressive forces, such as may arise if the wall regions of the gutter 1 on either side of the aperture were to move relative to one another. For example, if the arcuate region 17 of the cover 4 were to be driven to move toward or away from the edge 12 of the channel 2 because of flexure of panel 13 under high wind force, the movement may be resisted by prop 23. Because the bracket extends about the periphery of the cross sectional profile of the gutter 1 and bridges any gaps in that profile, the cross sectional profile of the bracket and gutter assembly becomes a closed profile, rather than the open cross sectional profile of either one of the gutter 1 or bracket 20 in isolation. The closed profile of the assembly may give improved rigidity (when compared to rigidity of the gutter alone) and may assist in resisting distortion and/or deformation of the gutter, especially in the cross sectional plane.

Preferably said bracket 20 defines a cross sectional shape that substantially corresponds with or compliments at least a region of the peripheral cross section of the gutter 1. In some embodiments there are a plurality of regions about the periphery of the profile of the gutter 1 where the bracket 20 runs contiguous with the exterior surface of the gutter 1. There may be a continuous contact and/or bearing between the surfaces of the bracket 20 and the gutter 1 along at least some parts of these regions, however at some regions the bracket may provide only point support. Preferably the bracket is contiguous with, or in contact with, a significant portion of the perimeter of the gutter 1 when viewed end on (for example, as can be seen in FIG. 4). In some embodiments the flat region 16 of the cover 4 may not be contacted by the bracket 20, but it is preferable that there be contact of the bracket 20 on at least some parts of the undercut region 50 of the cover 4.

In a preferred embodiment, there is a spacer or prop which supports the cover 4. Preferably that part of the bracket 21 which contacts the undercut region 50 of the cover 4 is contiguous with the part of the bracket 22 that contacts the second sidewall 9 of the channel formation 2 by way of an extension piece, spacer or prop 23 which bridges the aperture 6. This has the effect of reinforcing the spacing between the cover 4 and channel formation 2. When the gutter 1 is retained within a series of brackets 20, the prop 23 promotes a uniform height of the aperture 6 along the length of the gutter 1.

In a preferred embodiment the bracket 20 has upper 24 and lower 25 regions defined by a hinge point 26 about which said regions 24 & 25 are able to articulate relative to each other between an open condition and a closed condition. A preferred location for the hinge point 26 is within that region 27 of the hinge corresponding to the base profile 7 of the gutter section, for example as shown in FIG. 4. Location of the hinge 26 at this point allows the bracket 20 to be attached to the building surface at its upper region 24, and for the lower part 25 of the bracket to swing open in order to receive the gutter 1. When the gutter 1 is in place, the lower part 25 of the bracket 20 can be returned to its closed condition (that shown in FIG. 4), in which it is able to retain the gutter 1.

In some embodiments, where the required load bearing capacity of the nose region is low, the lower part 25 of the bracket may be removed entirely, in which case no hinge point 26 is required. In this embodiment the cover formation 4 is supported only at its fixed end 14.

Figure 11:
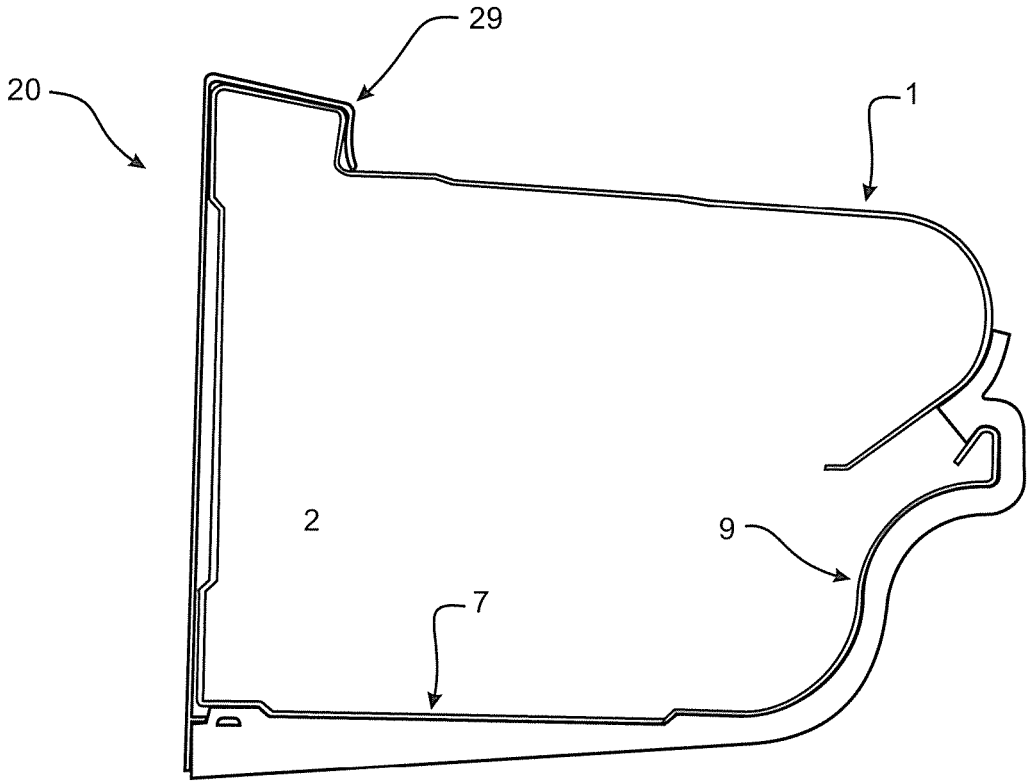
FIG. 11: shows a side view of an embodiment of a gutter assembly of the present invention comprising a gutter formed from two associable elements.
Figure 12:
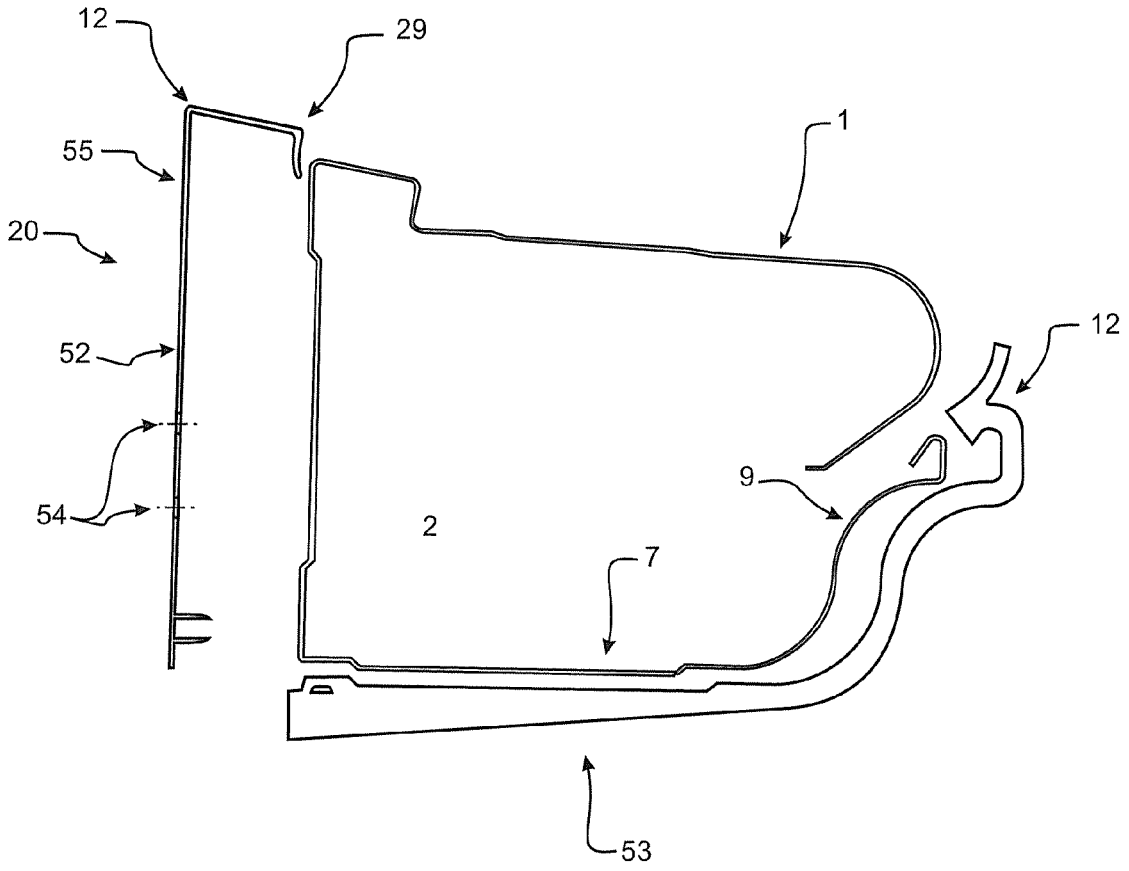
FIG. 12: shows an exploded of the gutter assembly of FIG. 11.

As shown in FIGS. 11 and 12, in some embodiments the bracket may comprise two releasably associable elements. A first element 52 may be adapted for fixing to a building surface, and preferably presents a planar surface to abut against the building surface when so fixed. For example, a rear flange 55 of the first element 52 may have holes 54 adapted to receive fasteners so that it can be affixed. A second element 53 may be associated with the first element 52 so as to extend contiguous with at least a region of the base 7 of the channel formation 2 of the gutter 1. Preferably the second element 53 extends beneath the base 7 of the channel 2 and up the front wall 9, so as to provide support from beneath the base 7 of the channel 2 and about the exterior of the gutter 1 as previously described.

It will be appreciated that a variety of means for associating the two elements 52,53 of the bracket 20 could be employed. For example, the association may be effected by way of a clip, fastener, hook, catch, receiver, latch, coupling or other form of attachment. Preferably elements 52 and 53 can be associated by directly engaging one with the other, for example, as shown in FIG. 12, the elements may carry complimentary features of a clip arrangement 56. In a further alternative embodiment, each of the elements 52 and 53 may be adapted to associate via a hinged joint so that one can be pivoted relative to the other.

In use, it is preferable that the two elements 52 and 53 are in an unassociated condition prior to commencing the installation of the gutter 1 on a building. A preferred method of installing a gutter and bracket assembly which comprises such a bracket 20 with two elements 52 and 53, is now described. The first element 52 of the bracket may be affixed to the building, and the gutter section 1 subsequently brought into proximity and aligned with the bracket element. There may be a feature of the bracket 20, for example a clip 29, which serves to initially locate and/or retain the gutter 1 relative to the bracket element 52. The second element 53 can then be associated with the first 52 so that the bracket 20 encloses at least a part of the peripheral profile of the gutter 1 including at least the base 7, and preferably the entire channel formation 2. In this configuration the gutter is supported relative to the building surface.

It is possible to perform the installation process without having to lift the gutter section 1 above the upper edges 12 of the bracket 20. Thus, for example, the gutter assembly can be installed at a mounting zone which is close beneath an eave of a building (and therefore not accessible from above the eave because the mounting zone would be obscured by the roof) yet mounting of the assembly can be effected by instead accessing the mounting zone and positioning the gutter components from beneath the eve. The two-part bracket configuration may therefore allow for convenient installation of a covered gutter system to new and retrofit installations across a plurality of roof designs, materials and construction methods.

In a preferred configuration for securely retaining the gutter 1, the gutter may have a projection 28 for engagement with the bracket 20. Preferably said projection 28 is a projecting cross sectional profile feature or upstand, and preferably this is one which extends upwardly from the cover portion 4 as shown in FIGS. 1 and 4. Preferably it is located at or near the upper end 12 of the first sidewall 8 of the channel formation 2, so that when the lower end 11 of the sidewall is supported by the bracket 20, the upper end 12 of the sidewall 8 is prevented from rotating outwardly from the building surface. The lower part 25 of the bracket 20 can then be swung into position and secured to the gutter 1, for example by way of a fixture through the arcuate portion 17 of the cover portion 4, or optionally at alternative or further points on the channel formation 2. This configuration constrains the gutter 1 against vertical, horizontal and rotational motion (relative to its cross sectional plane).

There may optionally be packing, preferably in the form of one or more packing plates, installed between the upper part 24 of the bracket and the fascia of the building to which the guttering is mounted in order to achieve the correct vertical alignment of the gutter channel and/or to sit the gutter section out from the fascia if required.

The bracket 20 preferably engages with the projection 28 by means of a clip formation 29 which is capable of a small elastic deflection to permit insertion of the gutter 1. Preferably the clip formation 29 will have sufficient return bias to its undeformed condition to hold the gutter 1 in place, but may additionally be fastened to the gutter 1, preferably at a point on the projection feature 28.

In another aspect the invention is a gutter system comprising sections of covered gutter 1 mounted to a building surface, or to a plurality of surfaces, so as to harvest water run-off from the building and channel it to a desired location, for example a drain or reservoir. Preferably the covered gutter system extends continuously around the exterior of the building, or significant portions thereof, and therefore preferably conforms to the peripheral shape of the building. For this reason the system additionally comprises section terminators 30 to be used to connect the open ends of adjacent linear gutter sections 1 (for example at corner or roof valley regions) or on the terminal ends of sections of gutter 1.

There may be provided, in assembly with a covered gutter 1 of the present invention, or separately from it, a section terminator 30 adapted to terminate a section of the gutter 1. The section terminator 30 most preferably is of a cross sectional profile which corresponds to the cross sectional profile of the gutter 1, or at least provides one or more end regions 31 for association with the gutter 1 which correspond to the cross sectional profile of the gutter 1.

Figure 5A:
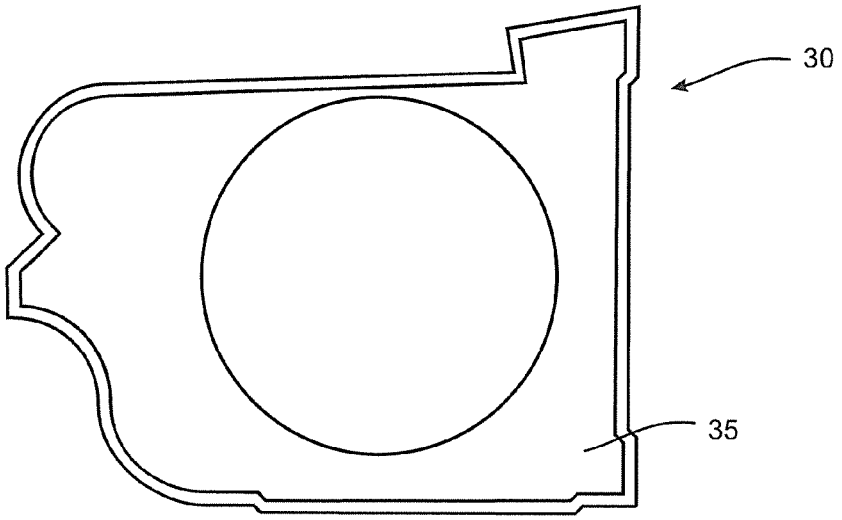
FIG. 5A: shows an end on view of an embodiment of a section terminator adapted to fit on the open end of a gutter section in order to perform a capping or sealing off function.
Figure 5B:
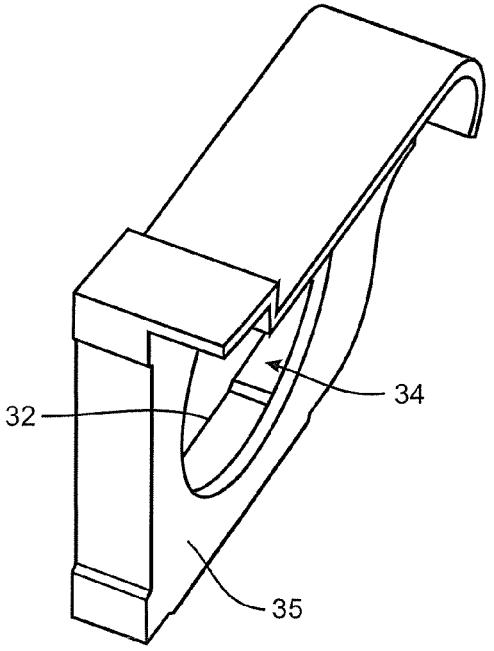
FIG. 5B: shows an alternative view of the section terminator of FIG. 5A, FIG. 5C: shows an alternative view of the section terminator of FIG. 5B, FIG. 6A: shows an exploded view of an embodiment of a section terminator having a body portion and a lid portion, and being adapted to fit intermediate of two co-axially aligned gutter sections.
Figure 5C:
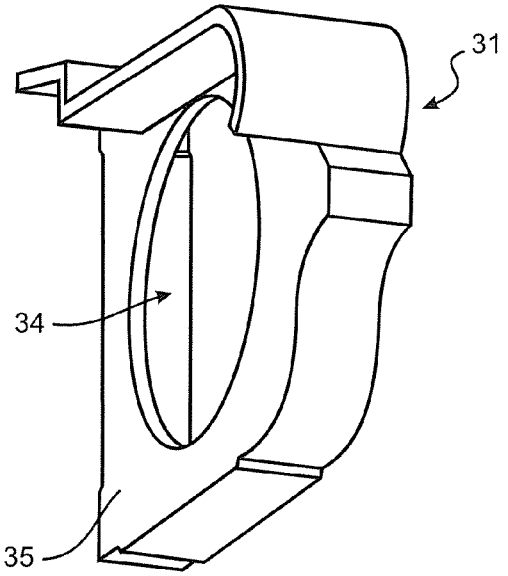

In FIGS. 5A through to 9 there are shown three preferred section terminators 30 of the present invention. In a first embodiment, shown in FIGS. 5A, 5B and 5C, there is a substantially planar terminator 30 which serves as a cap or closure to the open end of a gutter section 1. In a second embodiment, shown in FIGS. 6A and 6B, the terminator is adapted to be fitted intermediate two co-axially aligned sections of gutter 1. In a third embodiment, of which there are a number of variations including those shown in FIGS. 7, 8 and 9, the terminator 30 is adapted to connect the end regions of two sections of gutter 1 which are angularly offset from one another.

The section terminators are preferably of moulded plastic construction.

Figure 7:
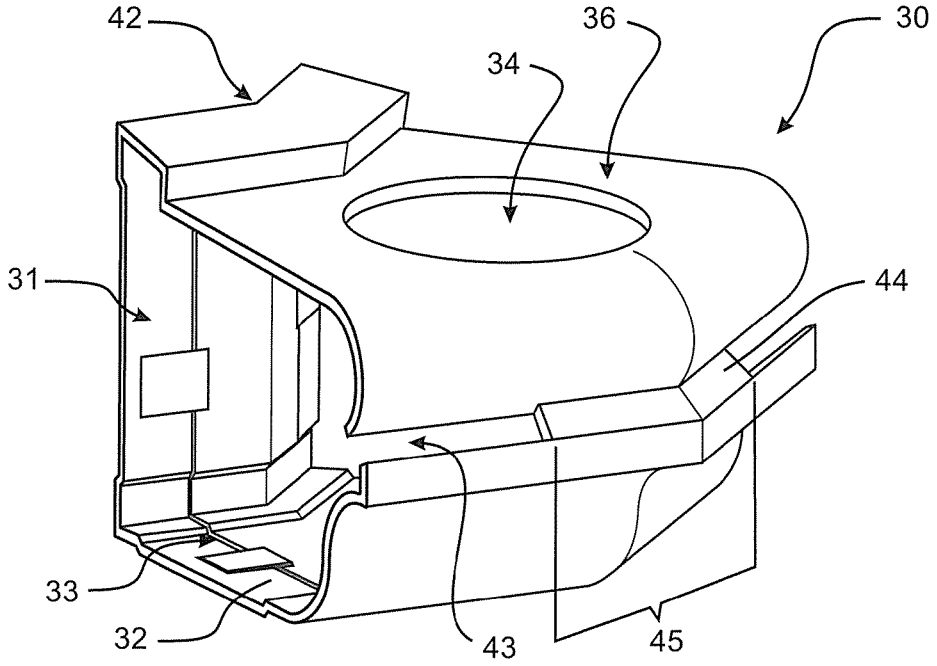
Figure 8:
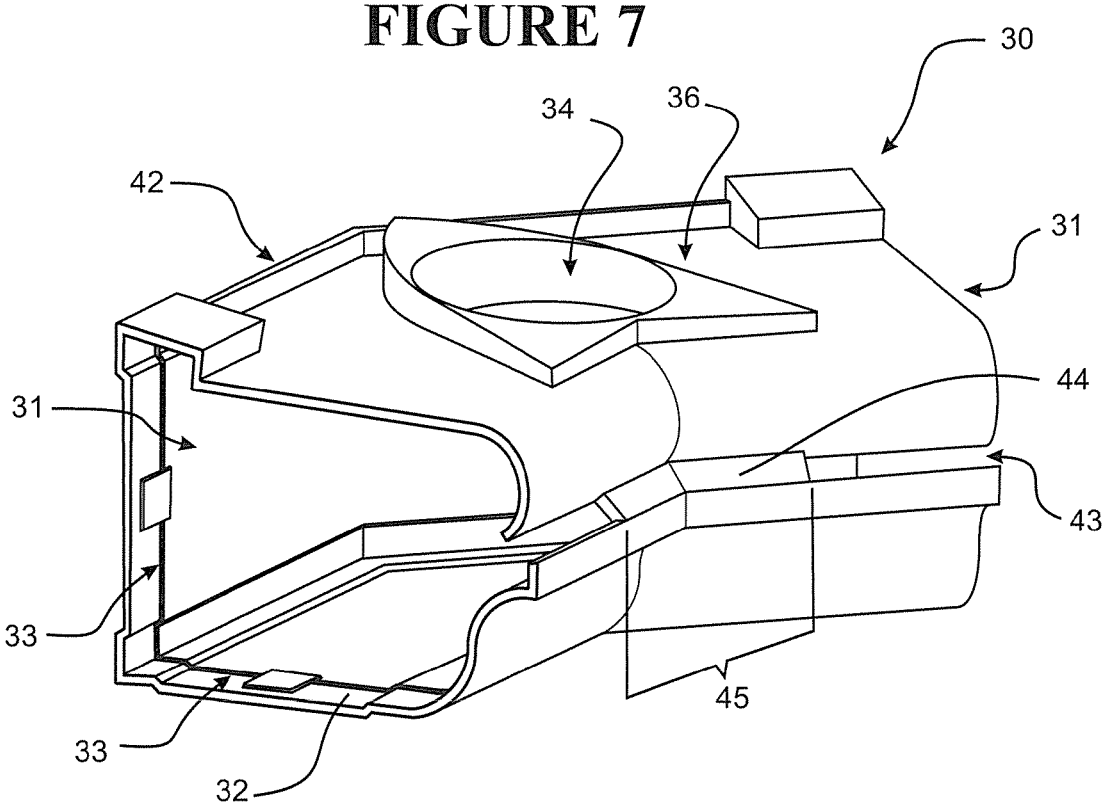
FIG. 8: shows an isometric view of an embodiment of a section terminator adapted to connect two sections of gutter channel oriented at a 135 degree angular offset from one another, wherein the aperture runs around the inside of the corner defined by the point of intersection of the channel axes.

Preferably the end region 31 of the section terminator has a lip 32 which extends in a direction normal to its cross sectional plane, the lip 32 defining a shape which, in cross sectional profile, matches the, or a substantial part of, the outer periphery of the profile of the gutter 1. It is preferable that the lip 32 achieves a push-fit engagement with the outer surface of the gutter 1 on insertion of the open end of the gutter section 1 into the end region of the section terminator 30. The lip 32 may also provide an internal step or edge 33 to butt against the open end of the section, as can be seen in FIGS. 7 and 8, which serves to restrict the amount of overlap that occurs when the gutter 1 and terminator 30 components are engaged.

Figure 10:
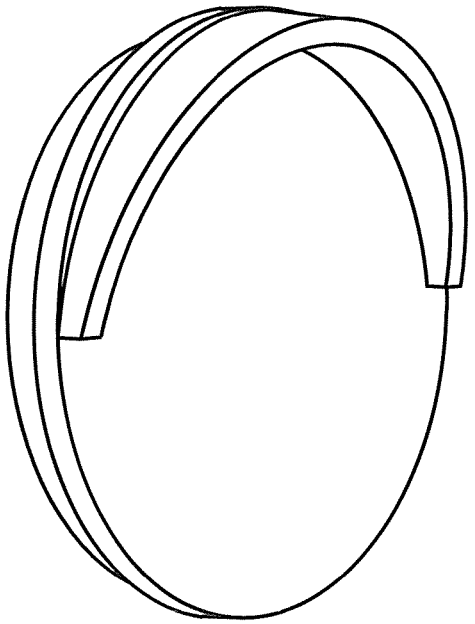
FIG. 10: shows a preferred circular cap style closure for insertion into a port of a section terminator of the present invention.

In a preferred embodiment the section terminator 30 has a port or opening 34. This can be used for inspection of and access to the interior of the terminator and/or the interior of the gutter for cleaning, flushing, mounting, assembly or repair. Preferably the port 34 is closeable, for example way of a hinged lid, screw in cap or press in plug. A preferred style of closure is the circular cap shown in FIG. 10. Alternatively the port 34 may instead be covered by a mesh or gauze.

The port 34 is located according to the function of the terminator 30. For a terminator 30 which functions as an end cap (for example that shown in FIGS. 5*a*, 5B and 5C) the port 30 may be located on a plane normal to the direction of the gutter channel axis 10 and preferably on a flat face 35 of the terminator 30. For a terminator 30 which functions as a corner connector (for example those shown in FIGS. 7, 8 and 9), preferably the port 34 is located in an upper surface 36 of the terminator 30 such that a person looking down from above the gutter system when installed for use would be able to see into the interior of the terminator 30.

Figure 6A:
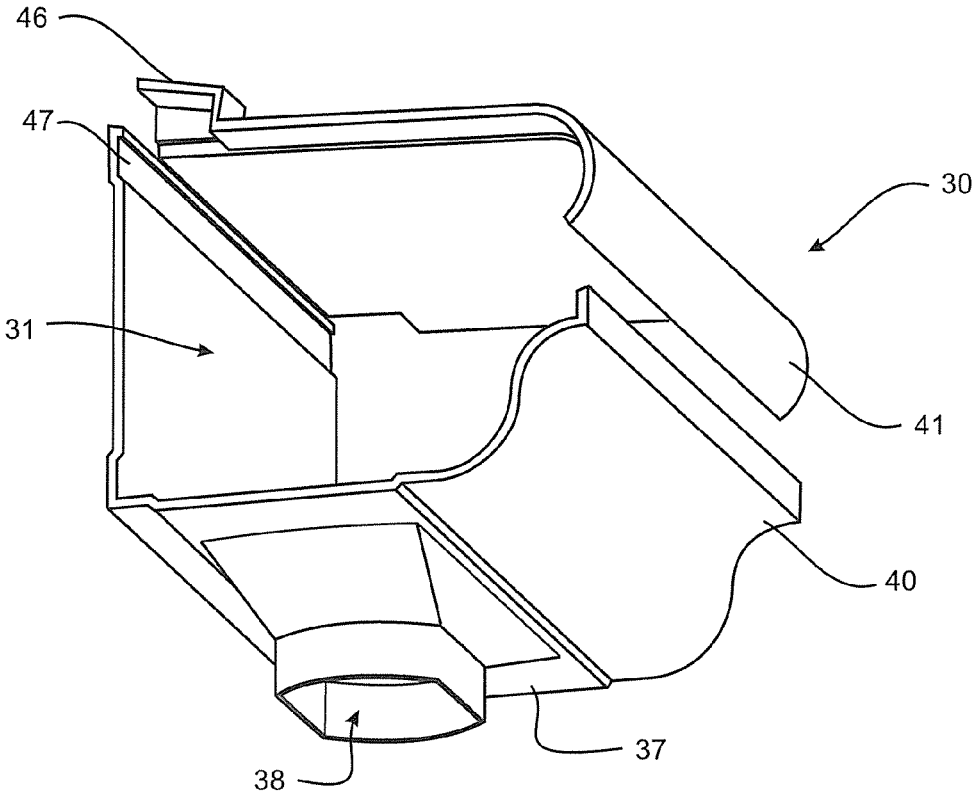
FIG. 6B: shows an alternative view of the section terminator of FIG. 6A, FIG. 7: shows an isometric view of an embodiment of a section terminator adapted to connect two sections of gutter channel oriented at a 135 degree angular offset from one another, wherein the aperture runs around the outside of the corner defined by the point of intersection of the channel axes.
Figure 6B:
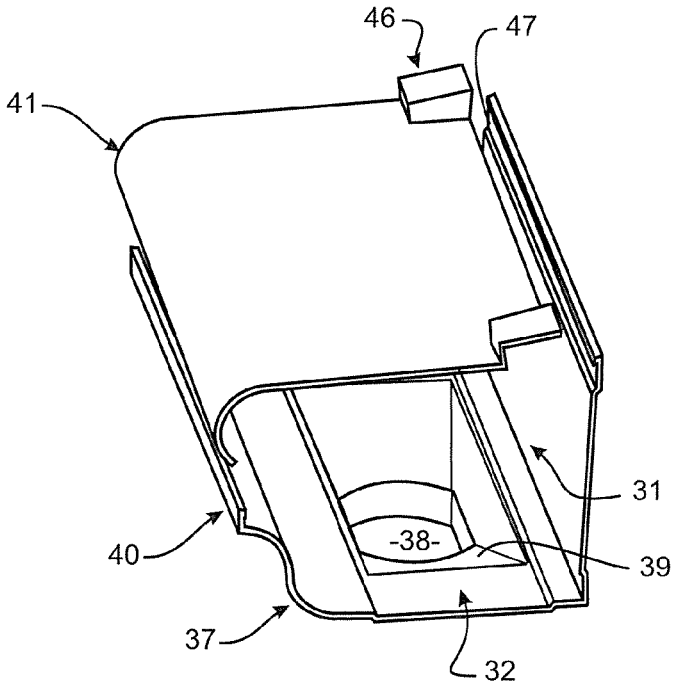

In a preferred embodiment of a terminator 30 to be installed intermediate of two co-axially aligned gutter sections, for example as shown in FIGS. 6A and 6B, there is on an underneath surface 37 of the terminator and aperture 38 adapted for connection to the open end of a down pipe or drain. At least some portions of the interior surface(s) 39 of the terminator 30 surrounding the aperture 38 are preferably sloped toward the aperture 38 to encourage water flow through it.

It is preferable that such a terminator 30 be made in two associable parts as shown in FIGS. 6A and 6B wherein there is shown a body portion 40 and a lid or closure portion 41. The parts may preferably be fitted together with a sliding engagement, or may be otherwise associated. Alternatively there may be a snap-fit inter-engagement of the body portion 40 with the lid portion 41 by way of an upstand 46 of the lid portion 41 (corresponding to the upstand 28 of the gutter section profile) being received into a recess 47 on the body portion 40. It is preferred that the parts 40 and 41 be associated so as to accommodate some degree of relative movement between themselves and between the open end of the gutter section 1 which they terminate. In this manner the terminator 30 can also act as a slip joint to allow for the expansion and contraction of the metal gutter sections 1 in the guttering system.

Figure 9:
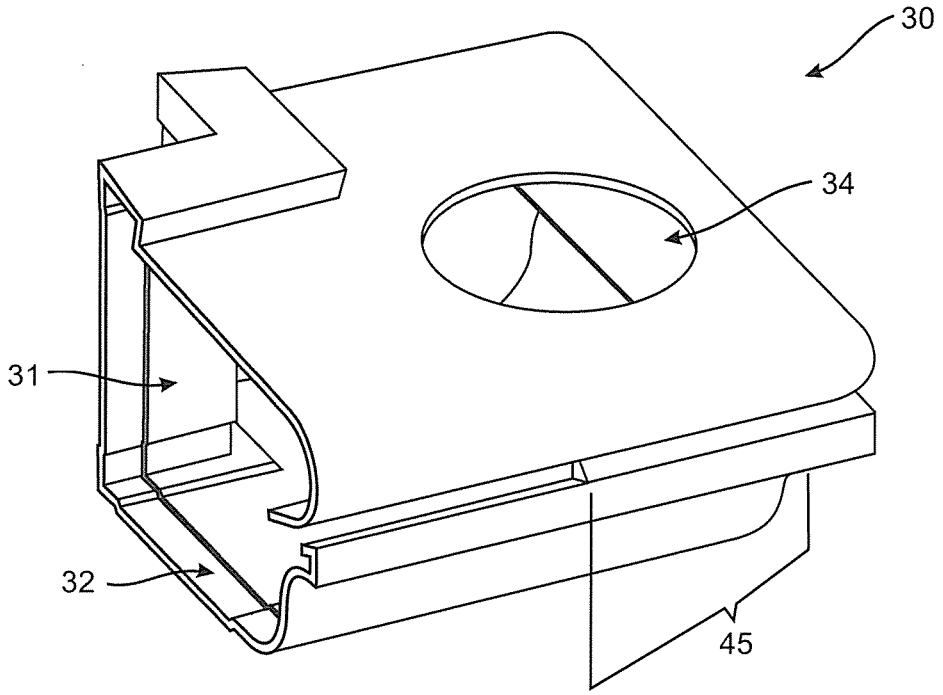
FIG. 9: shows an isometric view of an embodiment of a section terminator adapted to connect two sections of gutter channel oriented at a 90 degree angular offset from one another, wherein the aperture runs around the inside of the corner defined by the point of intersection of the channel axes.

In a preferred embodiment of a section terminator 30 to be installed to connect two angularly offset gutter sections 1, there is a corner connector terminator 30 having a rigid body 42 with two open end regions 31 oriented relative to one another so as to open in offset planes. The end regions 31 may be oriented to receive and retain the gutter sections 1 at a 90 degree offset (as shown in FIG. 9), or a 135 degree offset (as shown in FIGS. 9 and 8).

Preferably the corner connector terminator 30 has a longitudinal aperture 43 which corresponds to the aperture 6 of the gutter section 1 and functions in the same way to channel water into the interior of the terminator 30 while deflecting any solids in the water flow. The aperture 43 may be bridged by a reinforcing panel 44 at those regions 45 along the aperture 43 proximate to the point where the axes 10 of the two offset gutter channels 1 would intersect. As can be seen from FIGS. 7 to 9, the aperture may optionally run along the inside of the corner defined by the intersecting axes 10 or the outside of the corner so defined.

The gutter system may comprise any number of section terminators 30 in any combination of the embodiments described above. In a preferred embodiment the guttering system comprises at least one of each of a covered gutter section 1, a mounting bracket 20 and a section terminator 30.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. A covered gutter assembly comprising a covered gutter and at least one bracket, said bracket adapted to be fixed to a building and to support the covered gutter once so fixed, said covered gutter providing an elongate channel in which to receive water from an overhead water feed wherein the water may be carrying solid content, said covered gutter comprising:

a) a channel formation comprising front and rear walls upstanding from a base region to define a channel, and b) a cover formation extending from the rear wall of the channel formation and over the channel, there being an undercut portion of the cover which, together with an upper edge of the front wall of the channel, defines an elongate mouth opening along the gutter, and wherein said cover formation is adapted to guide water from the water feed through the mouth opening and into the channel, while assisting to deflect solid content away from the mouth opening, and wherein the bracket is contiguous about the exterior profile of the channel formation, so that when fixed, the bracket may support the gutter from beneath the base of the channel formation, and wherein the bracket has a rear flange which is adapted for fastening against a planar building surface and a lower member adapted to engage with the base of the channel formation, such that the covered gutter, when so engaged with the bracket, is constrained from movement relative to the building surface, and wherein said lower member has a detachable or hinged connection with the rest of the bracket so as to be able to assume an open condition wherein the gutter can be removed from the bracket.

2. An assembly as claimed in claim 1 wherein the channel formation and cover are formed as an integral profile from a single sheet of material.

3. An assembly as claimed in claim 1 wherein said gutter is adapted and configured such that, when mounted on a sidewall of a building, the mouth opening is positioned distal from the wall of the building on which the gutter is mounted.

4. An assembly as claimed in claim 1 wherein the cover of the covered gutter has a projecting profile feature for engagement with the bracket.

5. An assembly as claimed in claim 1 wherein an inner profile of the bracket complements or corresponds to at least part of the outer profile of the covered gutter.

6. An assembly as claimed in claim 1 wherein the bracket is adapted and configured to enable fastening to a building, so that, when fastened, the bracket may support the gutter from beneath the base of the channel formation.

7. An assembly as claimed in claim 1 wherein the bracket is contiguous about at least a part of the exterior profile of the cover formation.

8. An assembly as claimed in claim 1 wherein the bracket has a latch extending from an upper edge of the rear flange adapted to engage with a projection from the top of the cover formation.

9. A method of installing a covered gutter assembly as claimed in claim 1 comprising the steps of:

a) fastening the rear flange of the bracket to the building surface, b) optionally, if said bracket presented in its closed condition, articulating the lower member of the bracket about the hinge point so that the bracket assumes the open condition, 1) disposing the gutter section horizontally and locating it to engage with the latch, and 2) engaging the lower member to close around the exterior profile of the channel formation such that the bracket assumes the closed condition.

10. An assembly as claimed in claim 1 wherein a feature or features of the support bracket provide a prop to engage with one or both of the cover and the channel formation in order to retain the mouth opening at a constant width.

* * * * *